US006945503B2

(12) United States Patent
Cohen

(10) Patent No.: US 6,945,503 B2
(45) Date of Patent: Sep. 20, 2005

(54) PORTABLE MAGNETIC OBJECT HOLDER AND METHOD OF USING THE SAME

(76) Inventor: Gregg A. Cohen, 8311 Eastpoint Dr., Bldg. 400, Dallas, TX (US) 75227

( * ) Notice: Subject to any disclaimer, the term of this patent is extended or adjusted under 35 U.S.C. 154(b) by 0 days.

(21) Appl. No.: 10/269,059

(22) Filed: Oct. 11, 2002

(65) Prior Publication Data

US 2004/0069916 A1 Apr. 15, 2004

(51) Int. Cl.[7] ..... A44B 1/18

(52) U.S. Cl. ..... 248/206.5; 248/205.2; 224/183; 224/661; 224/904

(58) Field of Search ..... 248/205.2, 206.5, 248/230.8; 211/DIG. 1; 224/183, 661, 677, 678, 701.2, 901.4, 904, 701.4; 335/285, 306; 206/350, 818, 335

(56) References Cited

U.S. PATENT DOCUMENTS

| | | | | | |
|---|---|---|---|---|---|
| 2,597,601 | A | * | 5/1952 | Sherman | 43/57.1 |
| 3,233,802 | A | * | 2/1966 | Ludwick | 224/183 |
| RE28,289 | E | * | 12/1974 | Calkins | 224/584 |
| 3,886,508 | A | * | 5/1975 | Lavrard | 335/285 |
| 4,609,173 | A | * | 9/1986 | Belokin | 248/223.41 |
| 4,826,059 | A | * | 5/1989 | Bosch et al. | 224/183 |
| 5,011,102 | A | | 4/1991 | Kiefer | |
| 5,056,661 | A | * | 10/1991 | Balzano | 206/372 |
| 5,996,116 | A | * | 12/1999 | Tate | 2/12 |
| 6,000,414 | A | * | 12/1999 | Crusor | 135/66 |
| 6,029,872 | A | * | 2/2000 | Ellington | 224/251 |
| 6,073,823 | A | * | 6/2000 | Gordon | 224/661 |
| 6,381,890 | B1 | * | 5/2002 | Sjostedt | 40/637 |
| 6,422,955 | B1 | | 7/2002 | Lopez | |
| 6,427,340 | B1 | * | 8/2002 | Cohen | 30/298.4 |
| 6,530,508 | B1 | * | 3/2003 | Devine | 224/183 |
| 6,571,997 | B2 | * | 6/2003 | Dedrick | 224/183 |
| 2002/0170933 | A1 | * | 11/2002 | Martin | 224/197 |

* cited by examiner

*Primary Examiner*—Korie Chan
(74) *Attorney, Agent, or Firm*—Reed Smith LLP; Stanley P. Fisher, Esq.; Juan Carlos A. Marquez, Esq.

(57) ABSTRACT

The invention provides a portable magnetic object holder having a mounting plate embedded with at least one magnet for holding a magnetic object, such as a tool or instrument, on one surface of the mounting plate. A strap is attached to the mounting plate for mounting the mounting plate to a user or to an object.

2 Claims, 8 Drawing Sheets

PORTABLE MAGNETIC OBJECT HOLDER AND METHOD OF USING THE SAME

BACKGROUND OF THE INVENTION

1. Field of the Invention

The invention generally relates to a portable magnetic object holder having a mounting plate embedded with at least one magnet for holding a magnetic object on one surface of the holder. In particular, at least one strap is attached to the mounting plate for mounting the mounting plate to a moving object or a user.

2. Description of Related Arts

Currently, there are numerous examples for a magnetic holder made of plastic or metal for storing an object while not in use. U.S. Pat. No. 6,422,955 to Lopez teaches a golf ball marker holder for use by a golfer includes a magnetic top disk and a low seat with a butterfly-like clip. The holder mainly relies upon the squeezing force on the marker pin provided by the butterfly clip. However, if the marker is formed from a ferrous material, the magnetic force between the disk and the marker provides an auxiliary mechanism for holding the marker. In other words, the marker with a sharp pin is doubly secured, specifically jammed in the clip, to avoid any injury to the user.

U.S. Pat. No. 5,011,102 to Kiefer discloses a magnetic knife holder with cowlings 11, 12 and a magnetic strip 14 placed there between for mounting disk magnets 23. In particular, each of the cowlings 11, 12 has a curved entry 13 to clamp the knife 10 there between. The curved entry ensures any inserted knife is securely jammed so as to avoid any injury to the user. The magnetic force between the disk magnets 23 and the knife provides another mechanism for holding the knife. The disadvantage in this device is that it takes time to direct an object into the curved entry.

When a carpenter, a mechanic, an electronics or automotive technician, a fisherman, a butcher, a hunter, a gardener, a surgeon, a dentist, a hair-dresser, a fashion-designer, or an artist, is busy doing their job, their activities can entail different intermediate events, such as moving the target subject, changing tools, preparing gadgets or hardware. Some activities can even involve two-handed tasks. If a user uses any traditional magnetic tool/gadget/hardware holder while adjusting the position of the subject, the tool/gadget/hardware often is laid on a surface (table, ground, etc.) or put into a holder. Laying the tool/gadget/hardware on a surface may dirty or contaminate the tool/gadget/hardware. Also, reaching for a tool/gadget/hardware on the ground is usually farther than reaching for a holder carried by the user. However, it is often inconvenient for the user to precisely aim and insert the tool/gadget/hardware into a traditional holder.

In addition to a magnetic holding force, conventional magnetic object holders generally all come with a clamping or covering means for securing the tool/gadget/hardware to the holders which cover at least a portion of both sides of the tool/gadget/hardware rather than allowing one side the tool/gadget/hardware to be fully exposed.

Currently, there is no portable magnetic object holder facilitating easy and convenient use while the user is working and moving around, especially outdoors.

SUMMARY OF THE INVENTION

It is a purpose of this invention to provide a portable and hands-free magnetic object holder for holding at least one tool/gadget/hardware easily and safely while the user is working and moving around.

It is another purpose of this invention to allow an outdoor user to carry a tool/gadget/hardware easily and safely while the user is working and moving around.

It is still another purpose of this invention to provide a portable and hands-free magnetic object holder that has very few parts, is easy to make, and is easy to clean and maintain.

BRIEF DESCRIPTION OF THE DRAWINGS

The foregoing and additional features and characteristics of the present invention will become more apparent from the following detailed description considered with reference to the accompanying drawings in which like reference numerals designate like elements and wherein:

FIG. 2B showing a variation of the fourth embodiment in FIG. 3A; FIG. 2C showing a rear view of a fifth embodiment of the invention.

DESCRIPTION OF THE PREFERRED EMBODIMENTS

Figure 1A:
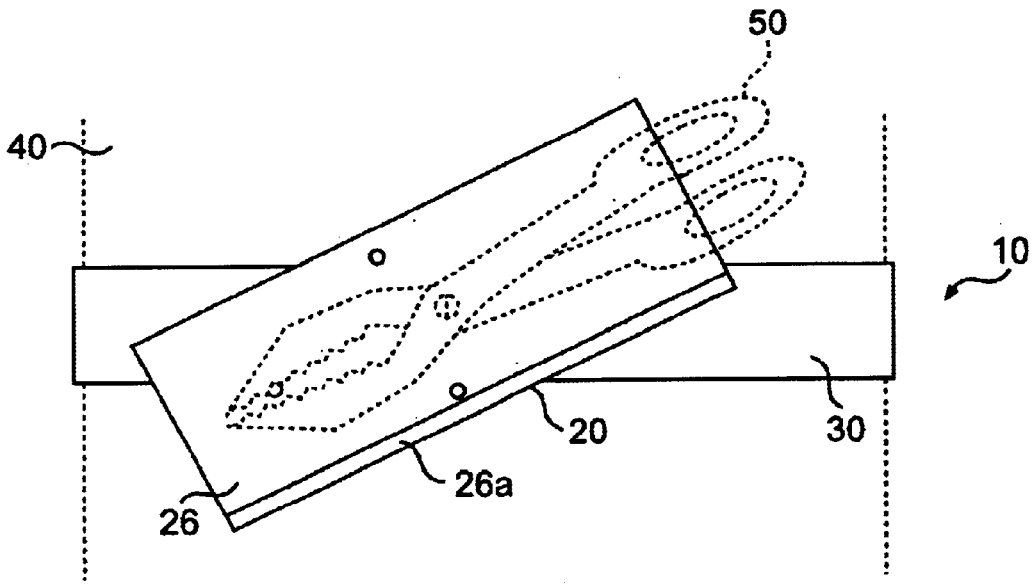
FIG. 1A is a schematic diagram of a first embodiment of the invention as it is worn on a leg and holding an object, with FIG. 1B showing a variation thereof.

Referring to the FIG. 1A, a tool or other instrument 50 (in broken outline) is placed on a mounting plate 20 of the object holder 10. The mounting plate 20 is attached to a mounting strap 30 so as to fasten onto a human leg 40 (in broken line). The mounting plate 20 is mounted to the mounting strap 30 at a 45 degree angle suitable for left or right handed people.

Figure 1B:
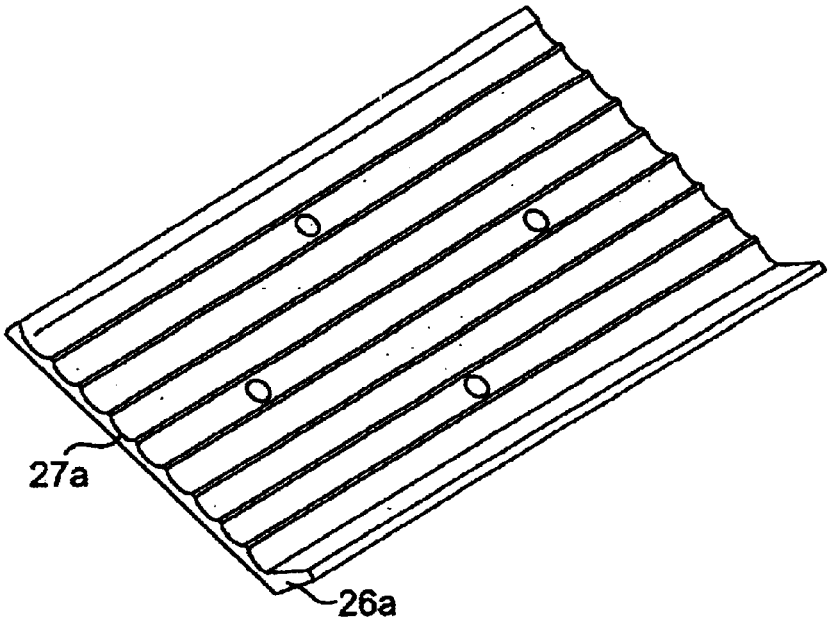

The mounting plate has a non-slip surface 26 made of rubber or other synthetic resin material that has one beveled side (FIGS. 1–2) or two beveled sides (FIG. 3B) 26*a* so that the tool 50 rests within a range of bevels even if it pivots rather than the blade tip leaving the surface area. The surface 26 may also have a texture or slits/grooves 27 to allow the blood to drain so as to insure a continuous grip (see FIG. 1B).

Figure 2A:
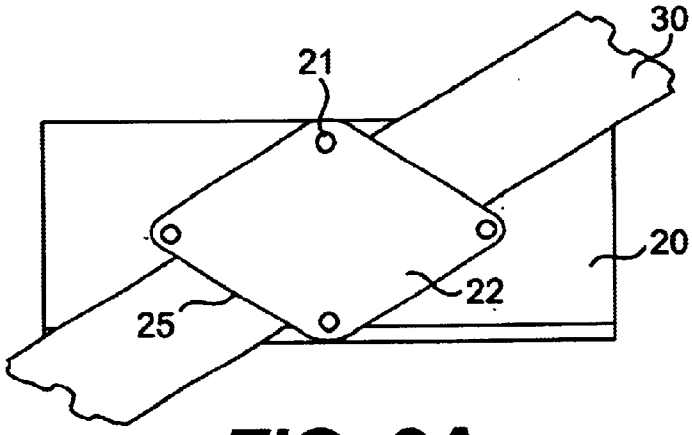
FIG. 2A is a rear view of the embodiment of the invention shown in FIG. 1.

The mounting plate 20 shown in rear view in FIG. 2A has four buckles or bolts 21 which fasten a diamond-shaped leather backing 22 to the mounting plate 20 to form a slit 25 for inserting the mounting strap 30 underneath the diamond-shaped leather 22 so as to attach the mounting plate 20 to another object.

Figure 2B:
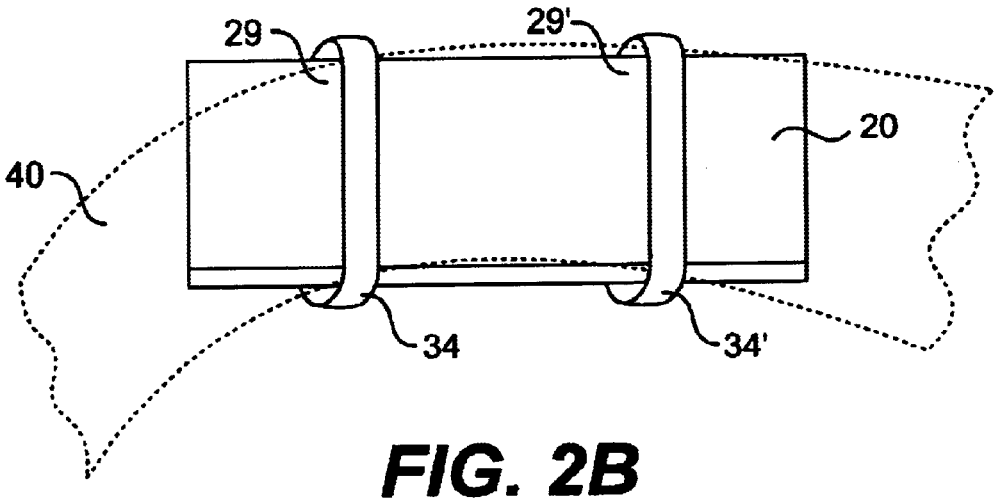
FIG. 2B showing a rear view of a second embodiment of the invention.
Figure 2C:
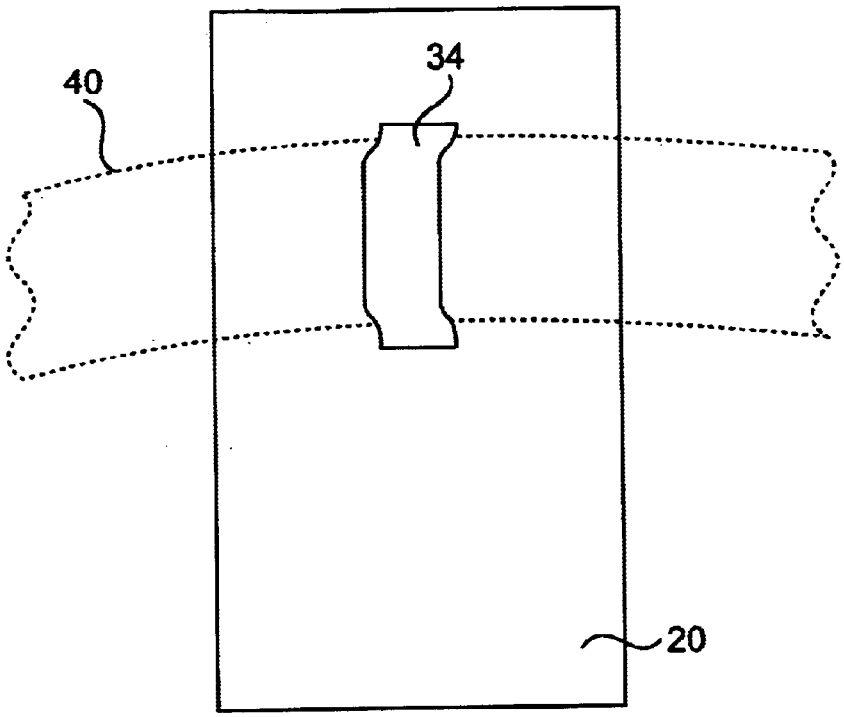
FIG. 2C showing a rear view of a third embodiment of the invention; with FIG. 2D showing the third embodiment in FIG. 2C worn by a user.
Figure 2D:
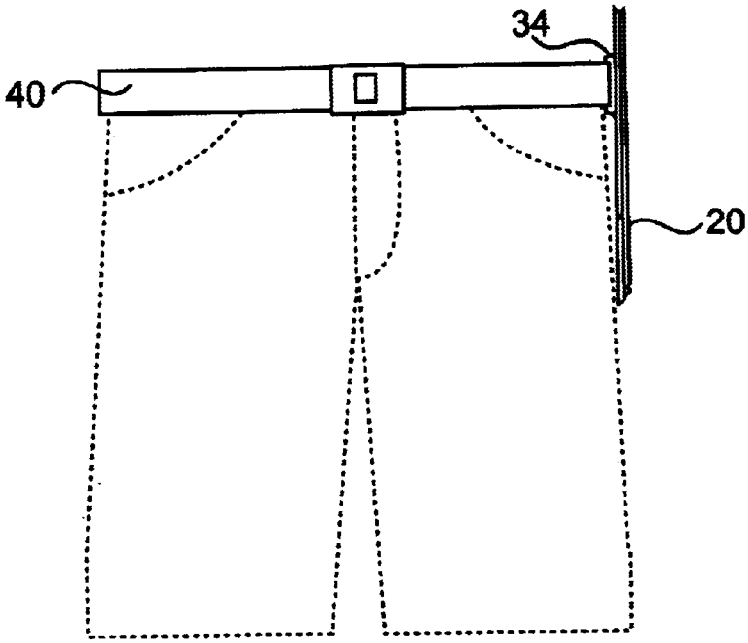

In another embodiment as shown in FIG. 2B, rather than the diamond-shaped leather backing 22 fixed on the back of the mounting plate 20 for an object to slip through, at lease one belt loop 34 is fixed on the back of the mounting plate 20 for a belt 40 to slip through. In a third embodiment as shown in FIG. 2C, rather than allowing the belt 40 to slip through at lease one belt loop 34 in parallel with the long sides of the mounting plate 20 as shown in FIG. 2B, the belt loop 34 in FIG. 2C is fixed on the back in parallel with the long side of the mounting plate 20 to allow the belt 40 to slip in the loop in a direction perpendicular to the long sides of the mounting plate 20. The hook-and-loop surface 32*a* covers the back of the mounting strap 30 and another strip made from the corresponding side of the pair of hook-and-lop surfaces 32*b* is in the middle of the mounting plate 20. FIG. 2D shows the third embodiment in FIG. 2C worn by a user.

Figure 3A:
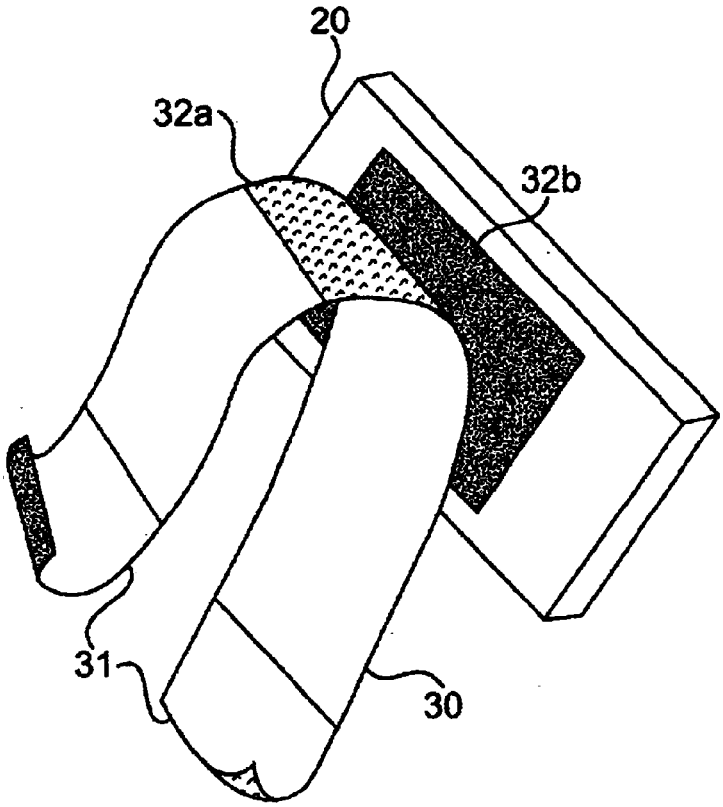
FIG. 3A shows a fourth embodiment of the invention.
Figure 3C:
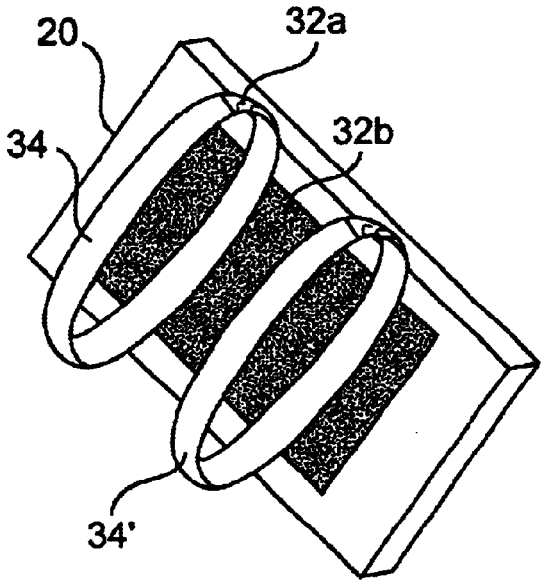
FIG. 3D showing a variation of the third embodiment in FIG. 2C; with FIG. 3E showing the fifth embodiment in FIG. 3D worn by a user.
Figure 3B:
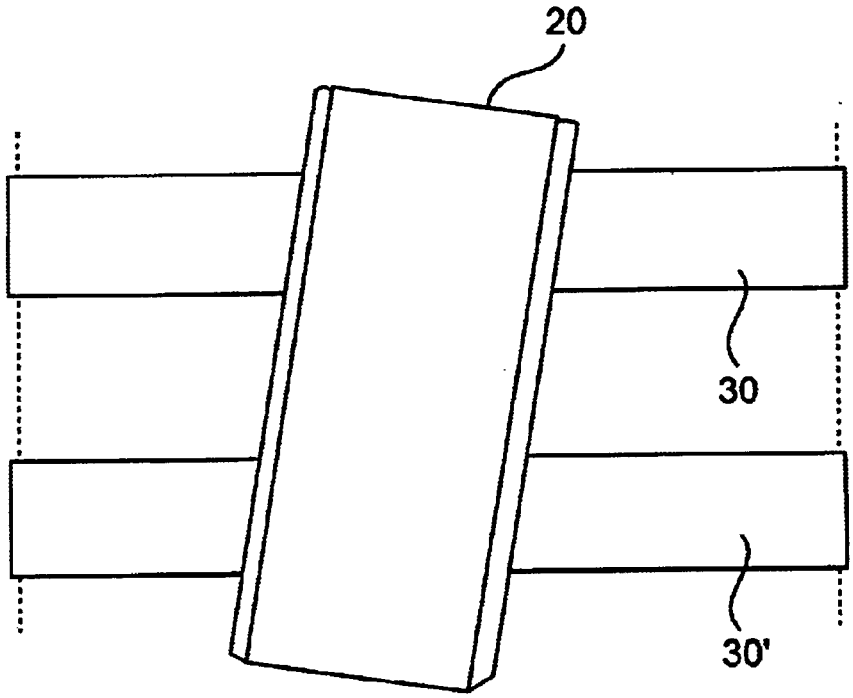
Figure 3D:
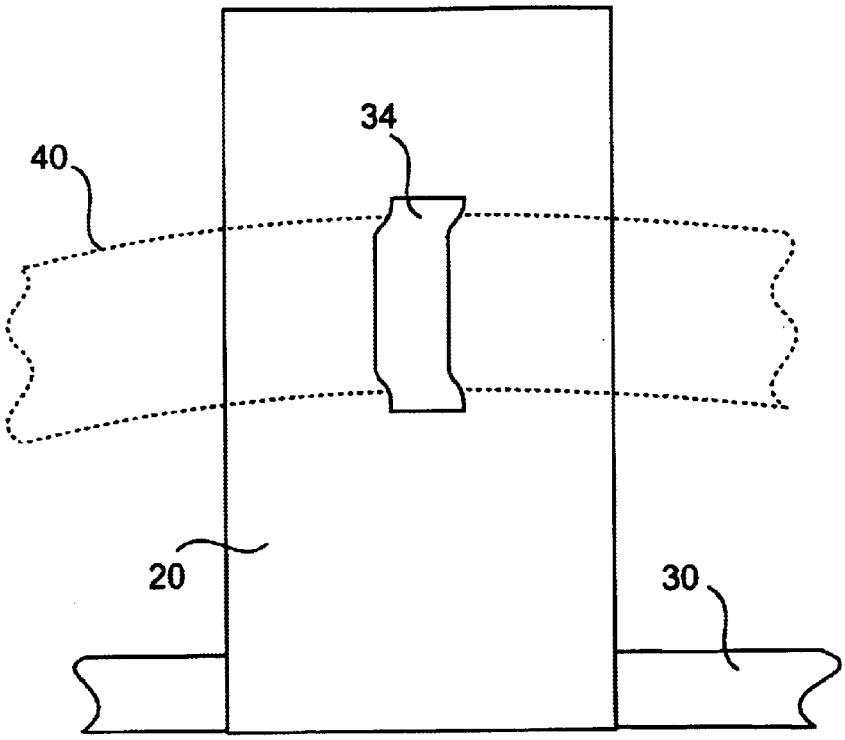
Figure 3E:
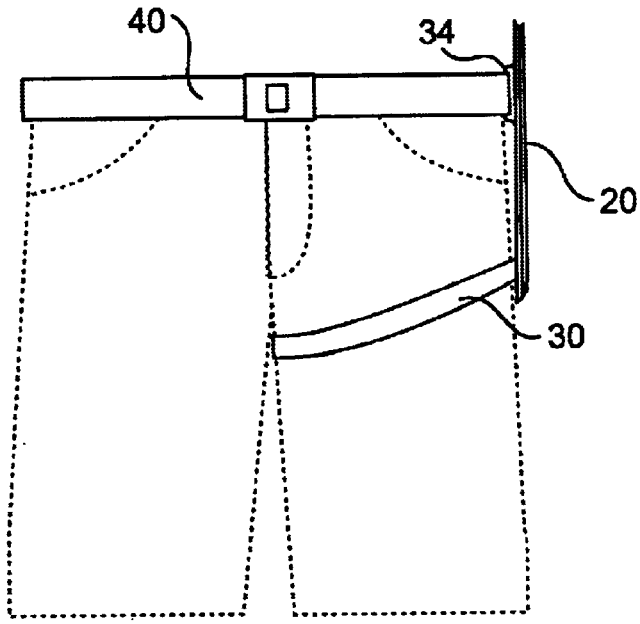

FIG. 3A shows a fourth embodiment of the invention. Rather than the diamond-shaped leather backing 22 or a pair of belt loops 34, 34' fixed on the back of the mounting plate 20 for an object to slip through, one side of a pair of hook-and-loop surfaces 32*a* covers the back of the mounting strap 30 and another strip made from the corresponding side of the pair of hook-and-lop surfaces 32*b* is in the middle of the mounting plate 20, which allows the user to mount the plate 20 to at least one mounting strap 30 at any selected angle. FIG. 3A shows one mounting strap 30, while FIG. 3B shows a pair of mounting straps 30, 30' for providing more support. FIG. 3C shows the pair of belt loops 34, 34' mounted on the mounting plate 20 via the hook-and-loop mechanism. FIG. 3D showing a variation of the third embodiment in FIG. 2C. A mounting strap 30 is added to the lower side of the mounting plate 20 to further secure the mounting plate 20 to the leg of an user as shown in FIG. 3E.

The mounting strap 30 is a 1.5 inch×24 inch piece of elastic material, such as Spandex®, with 1.5 inch×6 inch hook-and-loop tabs 31, such as Velcro®, at its ends for adhesion. Hook-and-loop surfaces facilitate any desired angle which enables the user to mount the magnetic object holder to a work surface, a human arm, wrist, or leg. Since the hook-and-loop surfaces do not stretch as much as leather, it gives more strength to the mounting plate 20.

Figure 4:
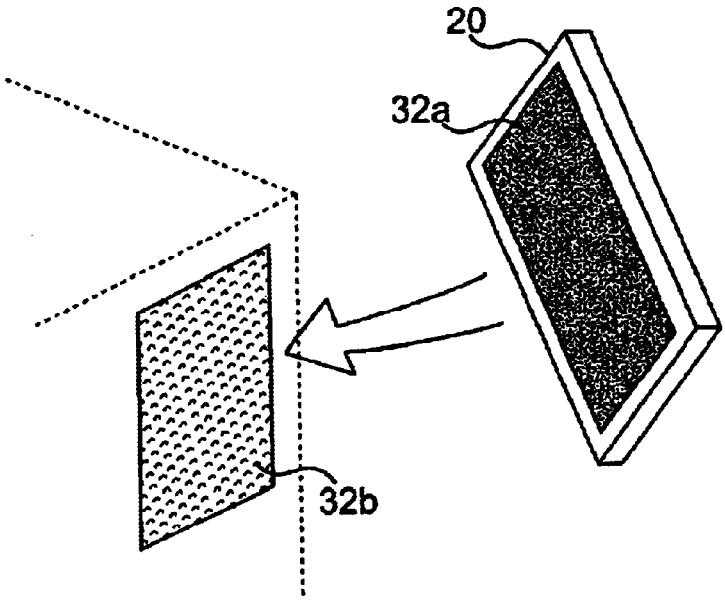
FIG. 4 shows a sixth embodiment of the invention.

In a sixth embodiment as shown in FIG. 4, the mounting plate 20 has the rear hook-and-loop surface 32*a* so as to attach the mounting plate 20 directly onto an object having the corresponding hook-and-loop surface 32*b* without the mounting strap 30 or the like.

The size of the mounting plate 20 varies according to dimensions and weight of a to-be-held object. A series of mounting plates of different size are provided for a user to choose. The hook-and-loop surfaces allow easy substitution of mounting plates. To support a heavy object with one or more bigger mounting plates, more than one mounting strap can be attached to one mounting plate.

Figure 5:
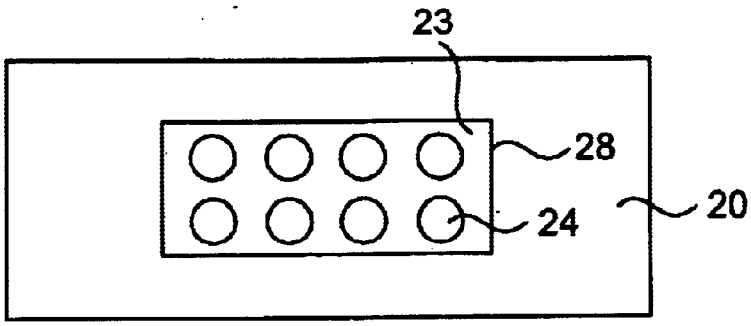
FIG. 5 is a longitudinal vertical section of the mounting plate taken on the magnetic seat of the embodiment of the invention illustrating the first embodiment of the magnet assembly mounted on the magnetic seat.
Figure 6:
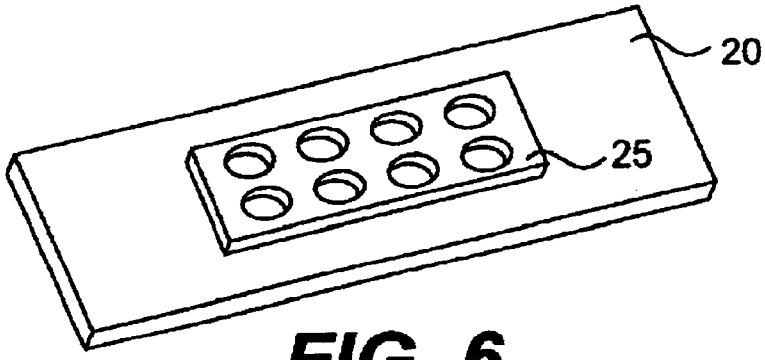
FIG. 6 is a perspective view the mounting plate of FIG. 5 without any magnets mounted on the magnetic seat.

As shown in FIG. 5, eight magnetic disks 24 are spaced evenly and mounted on a plate 23 to form a magnet assembly 28, which then is placed inside a seat 25 preformed in the mounting plate 20 as shown in FIG. 6. A tape (not shown) is used to cover the mounted magnet assembly 28. The tape then is covered underneath the diamond-shaped leather 22. As such, the magnetic force is felt on the non-slip surface 26 of the mounting plate 20. In other words, the magnets are spaced evenly throughout the area covered by the diamond-shaped leather 22.

Figure 8:
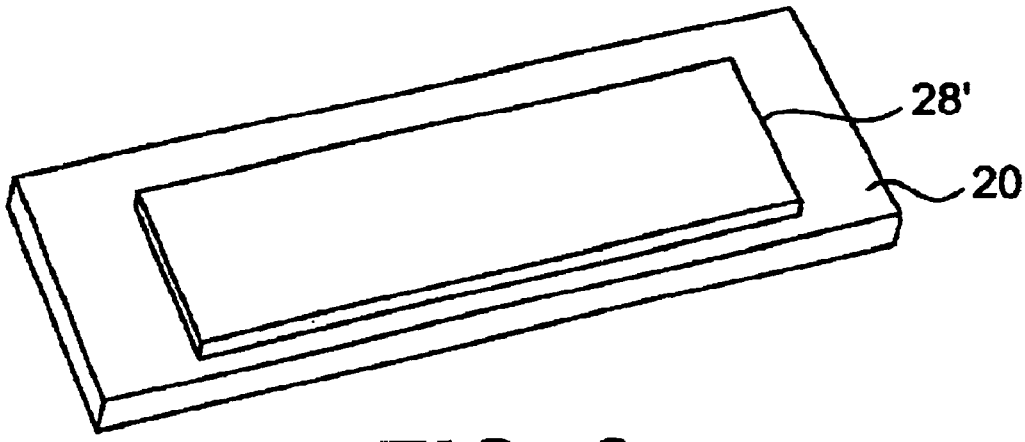
FIG. 8 is a perspective view the mounting plate with a plate magnet (second embodiment of the magnet assembly) mounted on a magnetic seat.

In another embodiment of the magnet assembly 28 as shown in FIG. 8, rather than the eight magnetic disks 24, a plate magnet 28' is mounted within the mounting plate 20.

The magnetic object holder 10 is strapped to one leg, for instance, at a height that would put the object handle at arm's length so as to free up a hand of the user to work on something else than holding the scissors. To mount the scissors to the magnetic object holder 10, the user simply has to lower the tool 50 to the magnetic object holder 10 to allow the blade to magnetically attach to the mounting plate 20. When the user is ready to reuse the knife 10, the user should only twist the knife handle slightly, while pulling away the handle from the magnetic object holder 10 to release the blade from the magnetic force. The magnetic object holder 10 can be washed thoroughly after use.

Figure 7:
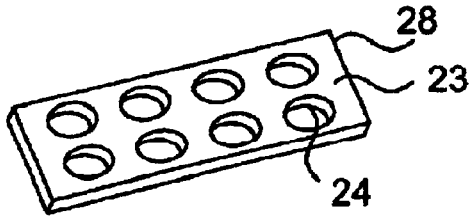
FIG. 7 is a perspective view the magnet assembly of FIG. 5.

The dimensions and strength of magnet(s) can be modified to adapt to different to-beheld objects or for ease of production. For example, a flat magnet plate is used to substitute the magnetic disks. The magnets can be made from ferrous, ceramic, or similar magnetic material. The magnets can be oriented randomly, but preferably to adjoining magnets with the same polarity. As shown in FIG. 7, the plate 23 that holds the magnets into an assembly is as thin as 1 mm to provide sufficient support without adding too much weight. The thickness of the seat is kept as thin as 1 mm to reduce the gap between the tool 50 and the magnet assembly 28 but still sufficiently support the mounting plate 20. The plate 23 can be made of aluminum, but preferably non-ferrous sheet metal and non-magnetic stainless steel.

The mounting plate 20 and the mounting strap 30 are made of an elastic and light material, such as rubber or plastic, so as to attach the magnetic object holder to objects of different sizes. The magnetic object holder of the invention has very few parts so as to be easily assembled and cleaned.

Any tool/gadget/hardware capable of being magnetized or attracted by a magnet can be held by the holder according to the present invention. Such a tool may be any device, such as a pair of scissors, a saw, a hammer, a wrench, screw driver heads of different sizes, etc. used to perform or facilitate manual or mechanical work. Such a tool may even be small specialized mechanical or electronic device, such as a flash light, an electrical drill, a portable dryer, a staples, a cellphone, a PDA, a calculator, etc. Further examples of hardware include keys, pens, rulers, batteries, fishing lures, needles, coins, paper clips, hair clips, pins, watercolor tubes, oil-color tubes, bullets, gliders, screws, bolts, nuts, washers, fasteners, hinges, etc.

The principles, preferred embodiments and modes of operation of the present invention have been described in the foregoing specification. However, the invention which is intended to be protected is not limited to the particular embodiments disclosed. The embodiments described herein are illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A portable magnetic object holder, comprising:

an elastic mounting plate embedded with a non-ferrous metal or non-magnetic stainless steel plate and a plurality of evenly placed magnets for holding a magnetic object on a top surface of the mounting plate, the magnets being joined by the non-ferrous metal or non-magnetic stainless steel plate; and attaching means is composed of at least one belt loop.

2. The portable magnetic object holder according to claim 1, wherein the attaching means attaches the rear surface of the mounting plate to a belt worn by the user.

* * * * *